US010272581B2

(12) United States Patent
Crispel

(10) Patent No.: US 10,272,581 B2
(45) Date of Patent: Apr. 30, 2019

(54) RIBBON CUTTER

(71) Applicants: Jeff's Circle Inc., Mississauga (CA); Samster Corporation, Toronto (CA); Sloan Holdings Inc., Toronto (CA)

(72) Inventor: Michael Crispel, Toronto (CA)

( * ) Notice: Subject to any disclaimer, the term of this patent is extended or adjusted under 35 U.S.C. 154(b) by 0 days.

(21) Appl. No.: 14/991,463

(22) Filed: Jan. 8, 2016

(65) Prior Publication Data

US 2016/0221203 A1 Aug. 4, 2016

(51) Int. Cl.

| | |
|---|---|
| ***B26D 1/06*** | (2006.01) |
| ***B26D 5/10*** | (2006.01) |
| ***B26B 29/06*** | (2006.01) |
| ***B26D 1/08*** | (2006.01) |
| ***B26B 27/00*** | (2006.01) |

(52) U.S. Cl.

CPC ..... *B26D 1/085* (2013.01); *B26B 27/00* (2013.01); *B26B 29/06* (2013.01); *B26D 5/10* (2013.01); *Y10T 83/8742* (2015.04); *Y10T 83/8773* (2015.04); *Y10T 83/8809* (2015.04); *Y10T 83/896* (2015.04)

(58) Field of Classification Search

CPC ..... Y10T 83/8773; Y10T 83/896; Y10T 83/9447; Y10T 83/7697; Y10T 83/8749; Y10T 83/7788; Y10T 83/7705; Y10T 83/8822; Y10T 83/889; Y10T 83/7726; Y10T 83/885; Y10T 83/8812; Y10T 83/773; Y10T 83/902; Y10T 83/8809; Y10T 83/8742; B26D 1/08; B26D 1/085; B26D 5/10; B26B 29/06

USPC ..... 83/768, 633, 694, 605, 606, 634, 647.5, 83/646, 564, 707, 733, 588, 581, 471.2, 83/489, 608–612, 648–650, 949, 950

See application file for complete search history.

(56) References Cited

U.S. PATENT DOCUMENTS

| | | | | | |
|---|---|---|---|---|---|
| 135,609 | A | * | 2/1873 | Ward | B26D 7/20 242/139 |
| 374,357 | A | * | 12/1887 | Geiger et al. | B26D 1/0006 242/559.2 |
| 842,919 | A | * | 2/1907 | Swank | B27B 5/10 30/124 |
| 869,308 | A | * | 10/1907 | William | B27B 5/10 30/124 |
| 909,599 | A | * | 1/1909 | Hotchkiss | A47K 10/38 225/23 |
| 1,462,871 | A | * | 7/1923 | Rosenberg | G01B 5/02 83/449 |
| 1,708,725 | A | * | 4/1929 | Huempfner | B65H 35/0046 118/43 |
| 2,026,402 | A | * | 12/1935 | Schlemmer | B65B 61/06 83/156 |

(Continued)

*Primary Examiner* — Laura M Lee

(74) *Attorney, Agent, or Firm* — Ralph E. Jocke; Walker & Jocke

(57) ABSTRACT

A ribbon cutter comprises a base and a turntable rotationally mounted on the base for movement between a plurality of rotational angles relative to a feed direction of the ribbon. A cutting arm pivotally connected to the turntable moves between an open position and a cutting position for cutting the ribbon at a selected angle determined by a rotational position of the turntable. A ribbon guide is provided for feeding a ribbon over the turntable, comprising an opening for manually drawing the ribbon through the ribbon guide to the turntable.

5 Claims, 4 Drawing Sheets

(56) References Cited

U.S. PATENT DOCUMENTS 2,224,100 A * 12/1940 Gautier ..... B65H 35/0046 118/41
2,447,145 A * 8/1948 Van Cleef ..... B65H 35/0026 225/18
2,643,070 A * 6/1953 Broeren ..... A47K 10/38 225/43
2,746,546 A * 5/1956 Taylor ..... B65H 23/10 118/43
2,766,823 A * 10/1956 Purmal ..... B43M 13/00 83/589
2,834,557 A * 5/1958 Graham ..... A47K 10/22 225/77
3,003,671 A * 10/1961 Graham ..... A47K 10/38 225/77
3,035,345 A * 5/1962 Barnard ..... B65H 35/0026 225/14
3,077,133 A * 2/1963 Hanscom ..... B65C 11/02 156/DIG. 49
3,207,019 A * 9/1965 Vanzo ..... B26D 1/04 83/277
3,296,911 A * 1/1967 McLane ..... B26D 1/151 83/118
3,455,197 A * 7/1969 Richardson ..... B26D 1/04 83/468.3
3,470,781 A * 10/1969 Domeny ..... B65H 35/002 225/23
3,487,863 A * 1/1970 Buckley ..... B23D 45/068 409/134
3,821,915 A * 7/1974 Larrable ..... B26D 1/185 83/174
3,839,937 A * 10/1974 Memain ..... C04B 28/02 83/34
3,946,631 A * 3/1976 Malm ..... B23D 47/025 83/380
4,510,834 A * 4/1985 Greene ..... B23D 23/02 83/453
4,555,967 A * 12/1985 Jumel ..... B65H 16/106 83/106
5,320,011 A * 6/1994 Lee ..... B26D 7/22 30/262
5,996,461 A * 12/1999 Croft ..... B26D 1/305 83/581
6,595,093 B1 * 7/2003 Artigas ..... B26D 1/30 83/468.3
2002/0043141 A1 * 4/2002 Bradfield ..... B23D 35/008 83/605
2007/0204737 A1 * 9/2007 Finkenbiner ..... B65H 35/002 83/649

* cited by examiner

RIBBON CUTTER

FIELD OF THE INVENTION

This invention relates to cutting tools.

BACKGROUND OF THE INVENTION

There are many different applications for the use of elongated sheets or strips of material that need to be custom-cut on site.

One example is hair colouring strips. During the hair colouring process a professional colourist will cut strips of aluminium foil, apply a hair dye to a bunch of hair strands, and wrap the foil around the coloured strands to encapsulate the dye while it sets into the hair and dries.

This process has certain disadvantages. Foil has essentially no thermal insulation value, and therefore cannot keep the colouring dye warm during the colouring process, which affects the permanence of the colouring. In the preferred embodiment a thin (5 mil) polystyrene foam strip is used in place of foil for hair colouring purposes. The wrapped polystyrene creates thermal conditions that are better for colouring than foil, and retains moisture for consistency of colouring.

Other uses for custom-cut strips from a ribbon include (without limitation) drywall tape, which must be cut to size to cover a joint between adjacent sheets of drywall; gift wrapping applications such as decorative ribbons; wallpaper borders; double-sided tape; and medical materials such as bandages.

For many such applications, one or both ends of a strip may need to be mitred, i.e. cut at an oblique angle. In some cases, for example when cutting drywall tape, the precision of the mitre is an important factor toward getting good results. Presently such strips are cut using scissors or a utility knife, which does not lend itself to cutting at precise angles and can lead to gaps or thickness overages in some applications.

It would accordingly be beneficial to provide a ribbon cutter capable of quickly and easily cutting mitred ends having specific and varying angles, with a high degree of precision.

BRIEF DESCRIPTION OF THE DRAWINGS

In drawings which illustrate one or more embodiments of the invention by way of example only.

DETAILED DESCRIPTION OF THE INVENTION

Figure 1:
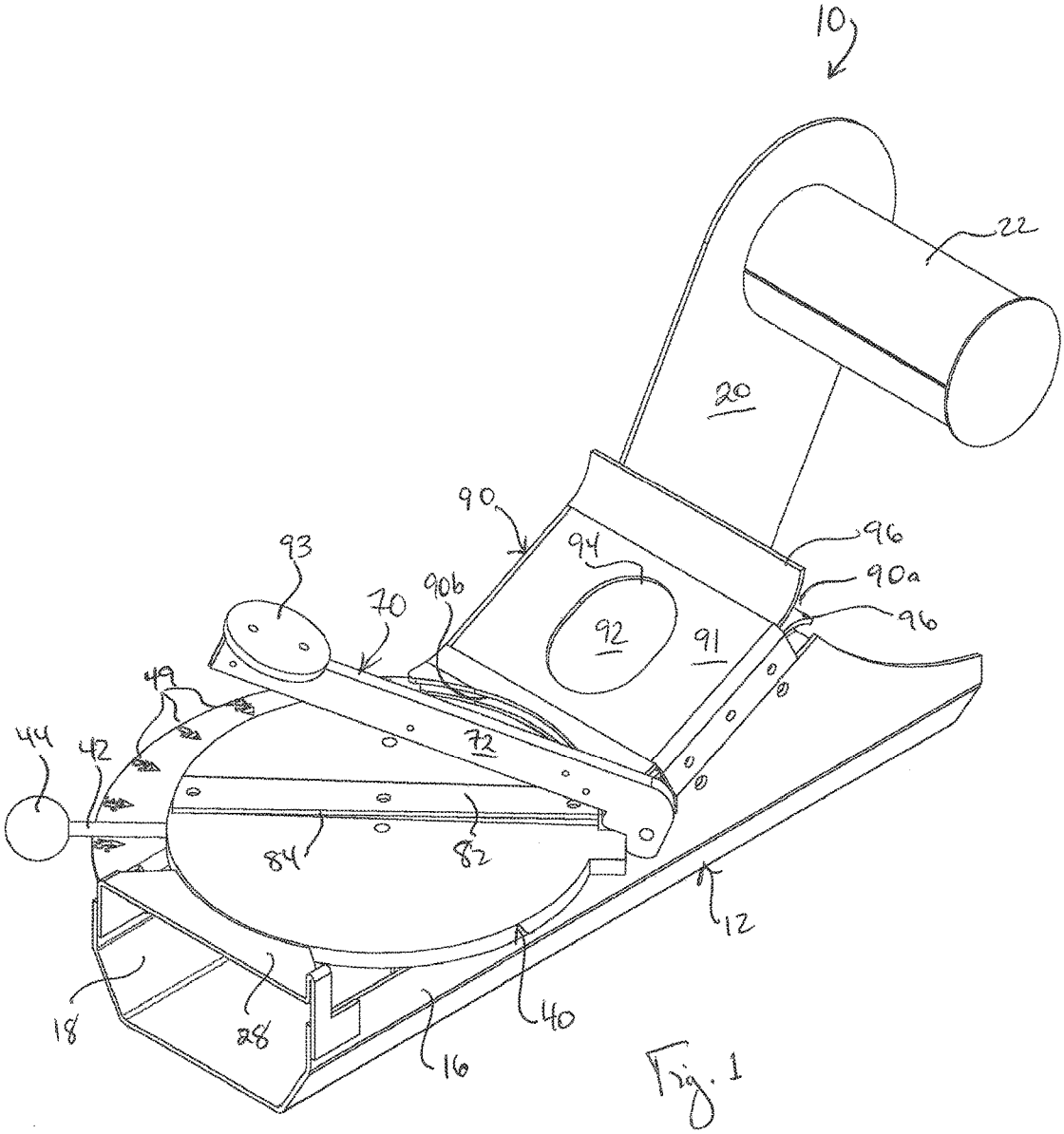
FIG. 1 is a perspective view of a ribbon cutter according to the invention.

An embodiment of the ribbon cutter 10 of the invention is illustrated in FIG. 1. The ribbon cutter 10 is suitable for cutting flexible strips, whether made from fabric, paper, foil or any other material capable of retaining its integrity while being fed through the ribbon cutter 10, and is not limited to any particular type or composition of flexible strip or any particular use or application for a flexible strip. The ribbon cutter 10 of the invention may be used to cut any angle. In the embodiment shown markings are provided for cuts between 90 and 45 degrees in either direction.

Figure 2:
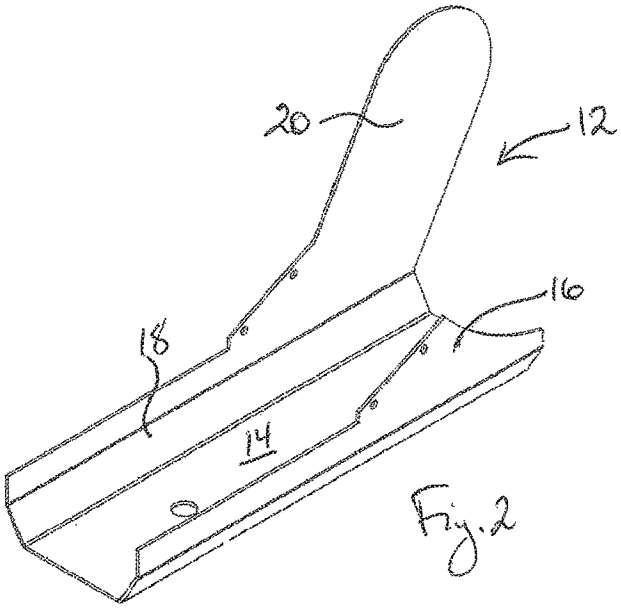
FIG. 2 is a perspective view of a base for the ribbon cutter of FIG. 1.
Figure 3:
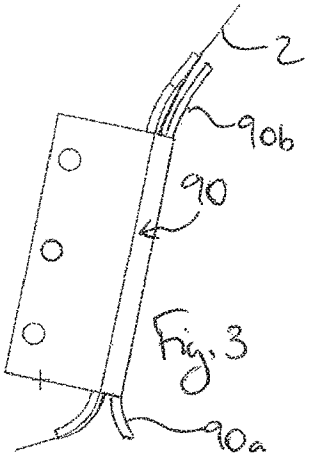
FIG. 3 is a perspective view of a turntable support for mounting to the base.

The ribbon cutter 10 comprises a base 12, illustrated in FIG. 2, in the preferred embodiment comprising a shoe having a bottom 14 and side walls 16, 18, and may for example be die stamped or otherwise formed from a suitable sheet metal such as galvanized steel. The base 12 may comprise an upstanding projection 20 supporting a roll holder 22 (seen in FIG. 1) on which a roll of ribbon 2 (shown in phantom in FIG. 5) may be mounted for convenience, which facilitates feeding the ribbon 2 in indeterminate lengths during use of the ribbon cutter 10. The ribbon 2 may alternatively be fed through the ribbon cutter 10 as pre-cut strips, in which case the upstanding projection 20 and roll holder 22 would be unnecessary.

Figure 6:
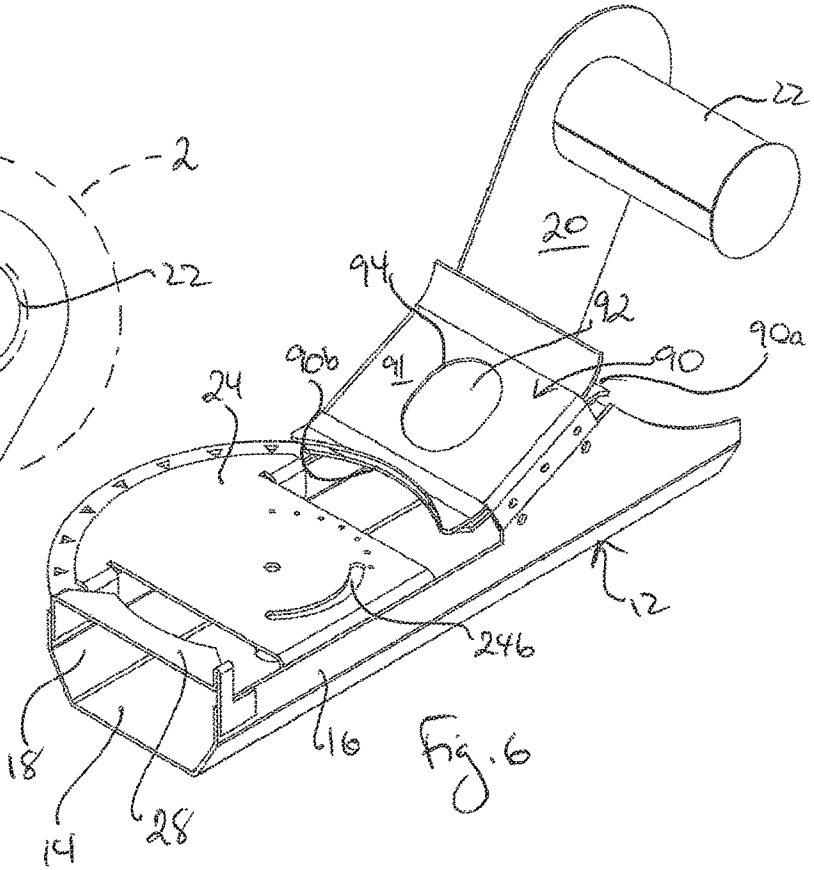
FIG. 6 is a perspective view of the ribbon feeder and turntable support mounted to the base.
Figure 5:
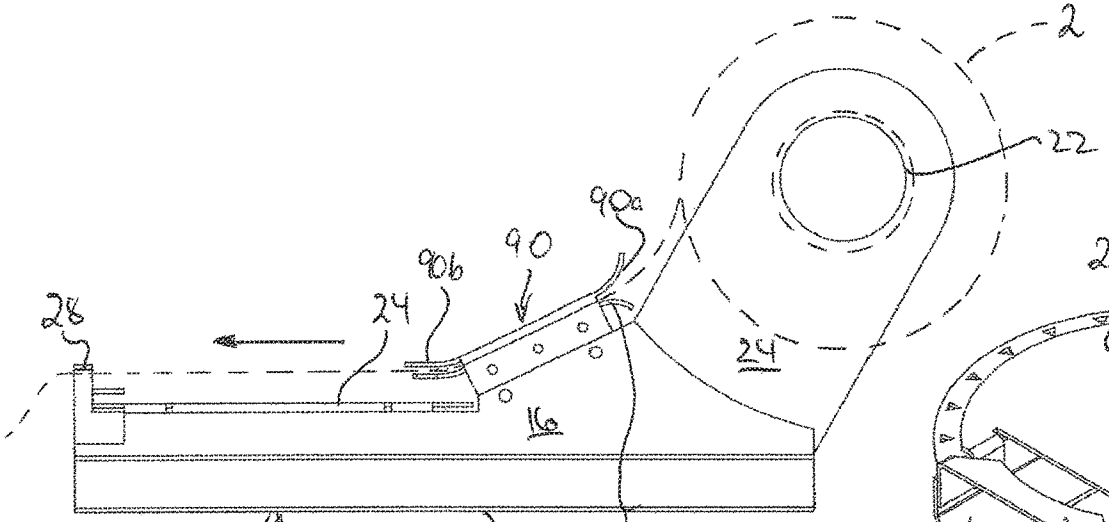
FIG. 5 is a side elevation of the ribbon feeder and turntable support mounted to the base.
Figure 7:
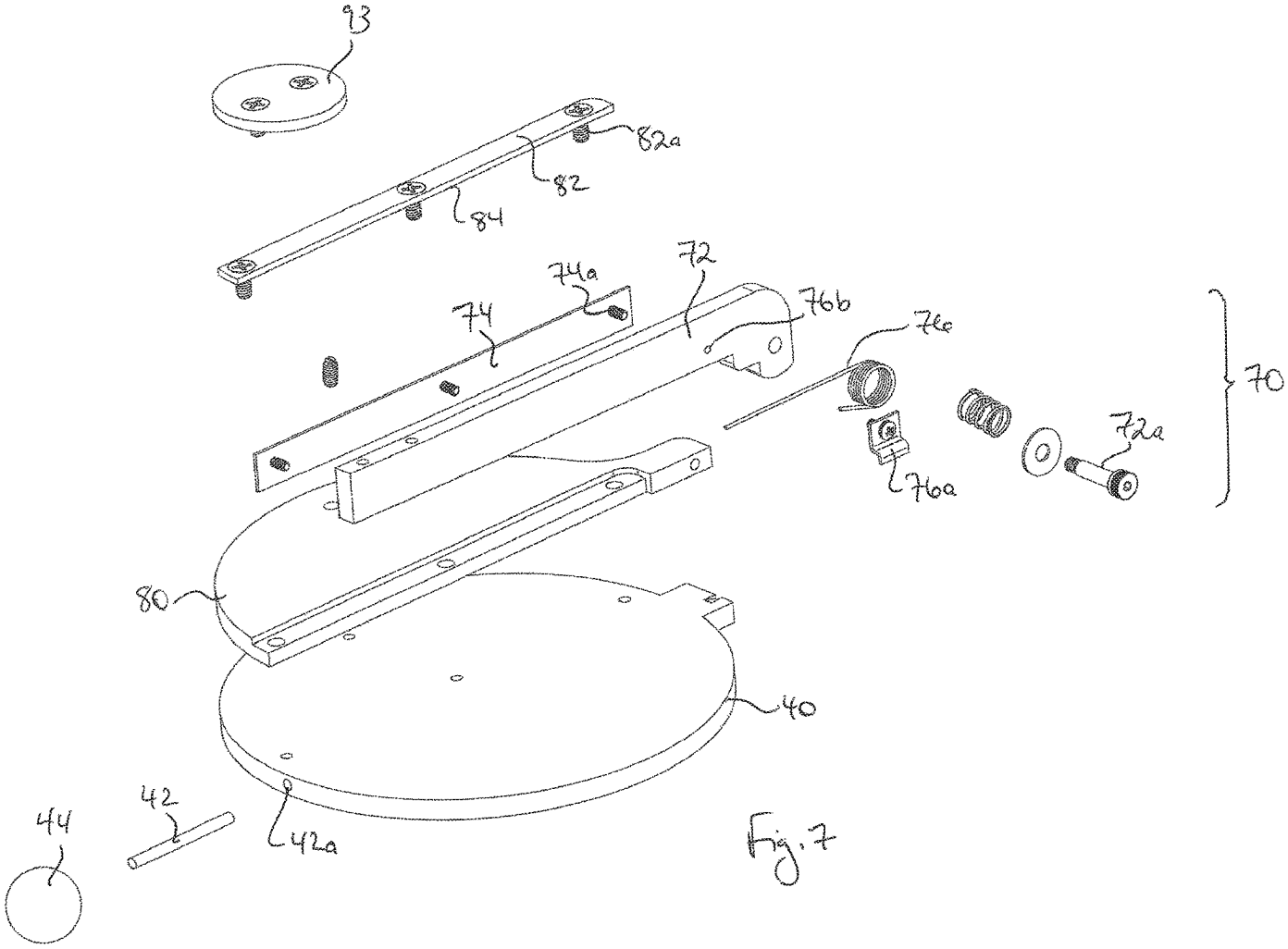
FIG. 7 is an exploded perspective view of the turntable and cutting arm.

The base 12 supports a turntable 40, an embodiment of which is illustrated in detail in FIG. 7, which is mounted on the base 12 for movement between a plurality of rotational angles relative to the feed direction of the ribbon 2 (shown by the arrow in FIG. 5). In the embodiment illustrated a turntable support 24, best seen in FIGS. 5 and 6, is mounted across the base 12 and supported by (for example spot-welded to) the sides 16, 18.

A cutting arm 70 is pivotally connected to the turntable 40 for cutting the ribbon 2 at a selected angle determined by the rotational position of the turntable 40, as best seen in FIG. 1. The cutting arm 70, illustrated in detail in FIG. 7, may for example be affixed by a spring-loaded bolt 72*a* having an aluminium spacer and a threaded end projecting beyond the spacer for engagement to a cutting edge member 80 comprising a shearing edge 84. The shearing edge 84 may be formed on a shearing bar 82 as illustrated, which is affixed to the turntable 40 through the cutting edge member 80, as by screws 82*a* shown in FIG. 7, such that the shearing edge 84 is immediately adjacent to the contact position of the cutting arm 70 with the turntable 40. The cutting arm 70 comprises a cutting bar 72 supporting a blade 74, for example affixed to the cutting bar 72 by screws 74*a*.

In the preferred embodiment the cutting arm 70 is biased to the open position, for example by torsion spring 76 fixed by spring retainer 76*a* affixed to the cutting bar 72 as at 76*b*. The cutting arm 70 is thus movable between an open position for positioning the ribbon, shown in FIG. 1, and a cutting position abutting the shearing edge 84 of the cutting edge member 80 for cutting the ribbon 2. A hand rest 93 may be affixed to the cutting bar 72 to render depressing the cutting arm 70 more comfortable. In the embodiment illustrated the cutting edge 84 coacts with the blade 74 to facilitate the cutting of the ribbon 2, however in certain applications it may possible, depending upon the composition of the ribbon material, to cut solely by the action of the blade 74 against the turntable 40.

A ribbon guide 90 for feeding the ribbon 2 over the turntable 40 is mounted to the sides 16, 18 of the base 12, positioned with its input end 90*a* facing the roll of ribbon 2 and its payoff end adjacent to the turntable 40. The ribbon guide 90 comprises a trapping plate 91 fixed over a ribbon feeding surface 92 in spaced relation by sides 96 which are affixed to the base 12, allowing room for the ribbon 2 to slide through the ribbon guide 90 between the trapping plate 91 and the ribbon feeding surface 92. The trapping plate 91 comprises an opening 94 through which the user can insert a finger to manually draw the ribbon 2 through the ribbon guide 90 to the turntable 40, frictionally engaging the ribbon 2 by depressing the ribbon 2 against the ribbon feeding surface 92 so that the motion of the user's finger toward the turntable 40 draws the ribbon 2 through the ribbon guide 90. The input end 90*a* may be provided with fluted lips 96 to facilitate feeding the ribbon 2 into the ribbon guide 90.

The turntable 40 is rotationally mounted onto the turntable support 24, for example in the embodiment illustrated the turntable support 24 is positioned so that the turntable 40 nests between the payoff end 90*b* of the ribbon guide 90 and an end plate 28 mounted across the payoff end of the base 12 and supported by (for example spot-welded to) the sides 16, 18. The payoff end 90*b* of the ribbon guide 90 and the end plate 28 provide curved edges along the periphery of the turntable support 24 complementary to the curvature of the turntable 40, retaining the turntable 40 in position over the turntable support 24 while allowing the turntable 40 to rotate to the desired angle. A ball knob 44 may be affixed to the turntable 40, for example as by pin 42 extending into a peripheral bore 42*a* in the turntable 40, to facilitate rotating the turntable 40.

Optionally the turntable support 24 comprises a slot 24*b* into which a ball nose spring plunger (not shown) projecting from the bottom of the turntable 40 depends, which both facilitates placement of the turntable 40 onto the turntable support 24 in the correct position, and imposes a limit on the degree to which the turntable 40 may be rotated within the selected range.

In operation, a roll of ribbon 2 (not shown) is loaded onto the roll holder 22 and the free end of the ribbon 2 is inserted into the ribbon guide 90. The turntable 40 set to the desired rotational position corresponding to the selected mitre angle of the end to be cut, for example by grasping optional ball knob 48 and forcing the turntable to the desired position. The used manually draws the ribbon 2 through the ribbon guide 90 until the free end of the ribbon 2 projects out of the payoff end 90*b* of the ribbon guide 90. The user may cut the free end of the ribbon 2 to a desired angle, or if the free end of the ribbon already has the desired profile the user then draws the ribbon 2 across the turntable 40 to the desired length to be cut. Stabilizing the ribbon 2 with one hand, the user depresses the cutting arm 70 to cut the ribbon to the desired mitre, freeing the cut length of ribbon 2 from the roll.

Figure 4:
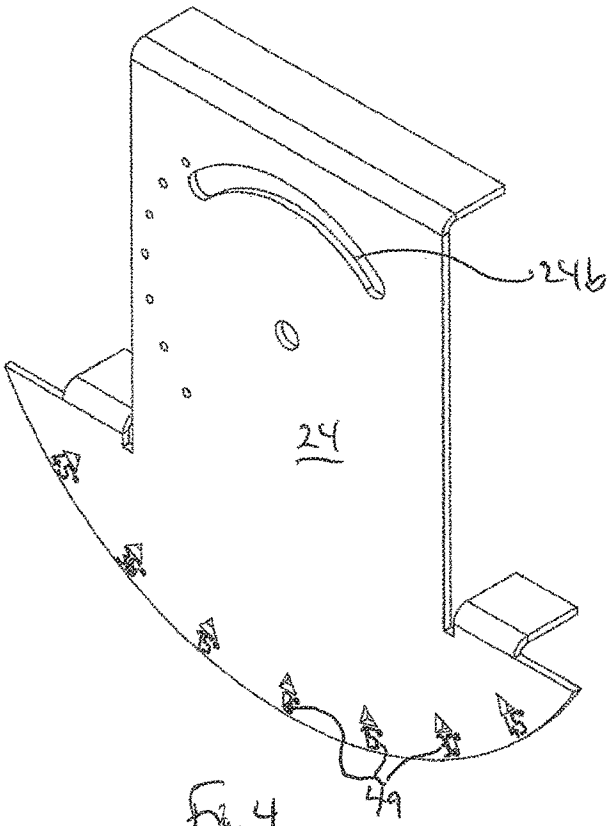
FIG. 4 is a perspective view of a ribbon feeder for mounting to the base.

The turntable 40 may be free-rotating, or may be provided with clicks coacting with detents (not shown) to releasably hold the turntable 40 in specific popular rotational positions. In the preferred embodiment markings 49 may be provided along the edge of the turntable support 24, as shown in FIGS. 1 and 4, for ease of selecting the desired rotational angle for each particular cut.

Various embodiments of the present invention having been thus described in detail by way of example, it will be apparent to those skilled in the art that variations and modifications may be made without departing from the invention. The invention includes all such variations and modifications as fall within the scope of the appended claims.

The invention claimed is:

1. A ribbon cutter, comprising a base, a projection, wherein the projection is in operative connection with the base, wherein in an operative condition of the ribbon cutter the projection extends above the base, wherein the projection is configured to support a roll of ribbon above the base;

a turntable rotationally movably mounted on the base, wherein the turntable is rotationally movable between a plurality of rotational angles relative to a feed direction of the ribbon, a shearing edge, wherein the shearing edge is in fixed operative connection with the turntable, a cutting arm pivotally operatively connected with the turntable, wherein the cutting arm is in fixed operative connection with a cutting blade, a turntable support, wherein the turntable support extends beyond a periphery of the turntable and includes rotational angle markings at selected rotational positions of the cutting arm, a spring, wherein the spring is operative to bias the blade toward an open position, wherein in the operative condition of the ribbon cutter, the cutting arm is movable between the open position wherein at least a portion of the blade is disposed above the turntable and away from the shearing edge, whereby ribbon is positionable between the blade and the shearing edge, and a cutting position in which the blade is in biased adjacent relation with the shearing edge, and wherein arm movement from the open position to the cutting position vertically cuts ribbon between the blade and the shearing edge at a selected angle determined by a rotational position of the turntable, a ribbon guide, wherein the ribbon guide extends in fixed overlying relation disposed above a ribbon feeding surface, wherein the ribbon guide is aligned with the feed direction, wherein ribbon is extendable between the feeding surface and the overlying ribbon guide, wherein the ribbon guide is configured to guide the ribbon to move in the feed direction between the guide and the feeding surface, wherein the overlying ribbon guide comprises an opening therethrough above the feeding surface configured to enable manual engagement with the ribbon through the opening and to draw the ribbon within the guide in the feed direction on the feeding surface through manual engagement of the ribbon through the opening, wherein the ribbon guide includes a payoff end adjacent to and above a top of the turntable, from which payoff end ribbon drawn through the ribbon guide extends, wherein the ribbon guide is operative to support and hold the ribbon that extends from the payoff end over the turntable in alignment with the feed direction, whereby the turntable can be set to a desired rotational position to cut the ribbon at a selected angle relative to the feed direction of the ribbon, whereby the ribbon cutter is enabled to be set to any of the plurality of rotational positions to vertically cut the ribbon extended above the top of the turntable at a plurality of selected angles relative to the feed direction of the ribbon.

2. The ribbon cutter of claim 1 wherein the turntable support comprises a slot defining a limit on the degree to which the turntable may be rotated within a selected range for limiting an angle of rotation of the turntable.

3. The ribbon cutter of claim 1 wherein the ribbon feeding surface is mounted at a downwardly extending angle relative to the turntable.

4. An apparatus comprising:

a ribbon cutter operative to selectively cut flexible strip ribbon, wherein the ribbon is elongated in a feed direction, including a cutter base, a projection, wherein the projection is in operative connection with the base, wherein in an operative condition of the ribbon cutter, the projection extends above the base, wherein the projection is configured to support a roll of the ribbon above the base, a cutter turntable in rotatable supporting connection with the cutter base, wherein the turntable is selectively rotatable between a plurality of rotational positions relative to the feed direction of the ribbon from the roll, wherein the cutter turntable includes a shearing edge, a ribbon guide, wherein the ribbon guide includes a plate and a feeding surface, the plate extending across and in fixed overlying relation of the feeding surface and is disposed above the feeding surface, wherein the overlying plate of the ribbon guide includes an opening therethough above the feeding surface, wherein the opening is configured to enable manual engagement of the ribbon through the opening and manual movement of the engaged ribbon in the feed direction within the guide between the plate and the feeding surface by manual engagement through the opening while the ribbon is in engagement with the feeding surface, wherein such manual engagement is operative to move the ribbon through the ribbon guide along the feed direction and from a payoff end of the ribbon guide adjacent to and above a top of the turntable, wherein the payoff end extends over the top of the turntable, wherein the ribbon guide is operative to support the ribbon that extends from the payoff end over the top of the turntable and to hold the ribbon in alignment with the feed direction, a cutting arm, wherein the cutting arm is in pivoting movable operative connection with the turntable, wherein the cutting arm comprises a blade, at least one spring, wherein the at least one spring is operative to bias the blade toward an open position, wherein in the operative condition of the ribbon cutter, the cutting arm is movable between the open position in which the blade is disposed upwardly away from the ribbon extending over the turntable, wherein in the open position of the cutting arm the ribbon is selectively manually positionable over the turntable, and a cutting position, wherein during cutting arm movement from the open position to the cutting position, the at least one spring is operative to cause the blade of the cutting arm to be biasingly positioned adjacent to the shearing edge to vertically cut the ribbon at a selected angle relative to the feed direction, wherein the selected angle corresponds to the selected rotational position in which the turntable is positioned when the cutting arm is moved from the open position to the closed position.

5. A ribbon cutter, comprising a base, a turntable rotationally movably mounted on the base, wherein the turntable is rotationally movable between a plurality of rotational angles relative to a feed direction of the ribbon, a shearing edge, wherein the shearing edge is in fixed operative connection with the turntable, a cutting arm pivotally operatively connected with the turntable, wherein the cutting arm is in fixed operative connection with a cutting blade, wherein in the operative condition of the ribbon cutter, the cutting arm is movable between an open position wherein at least a portion of the blade is disposed above the turntable and away from the shearing edge, whereby ribbon is positionable between the blade and the shearing edge, and a cutting position in which the blade is in adjacent relation with the shearing edge, and wherein arm movement from the open position to the cutting position vertically cuts ribbon between the blade and the shearing edge at a selected angle determined by a rotational position of the turntable, a ribbon guide including a plate and a ribbon feeding surface, wherein the plate extends across and in fixed overlying relation of the ribbon feeding surface and is disposed above the ribbon feeding surface, wherein the ribbon guide is aligned with the feed direction, wherein ribbon is extendable between the plate and the ribbon feeding surface, wherein the ribbon guide is configured to guide the ribbon to move in the feed direction between the plate and the feeding surface, wherein the overlying plate of the ribbon guide includes an opening therethrough above the feeding surface configured to enable manual engagement with the ribbon through the opening and to draw the ribbon within the guide between the plate and the feeding surface in the feed direction on the feeding surface through manual engagement of the ribbon through the opening, wherein the ribbon guide includes a payoff end adjacent to and above a top of the turntable, from which payoff end ribbon drawn through the ribbon guide extends, wherein the ribbon guide is operative to support and hold the ribbon that extends from the payoff end over the turntable in alignment with the feed direction, whereby the turntable can be set to a desired rotational position to vertically cut the ribbon at a selected angle relative to the feed direction of the ribbon, whereby the ribbon cutter is enabled to be set to any of the plurality of rotational positions to vertically cut the ribbon extended above the top of the turntable at a plurality of selected angles relative to the feed direction of the ribbon.

* * * * *